US006170416B1

(12) United States Patent
Gulsby

(10) Patent No.: US 6,170,416 B1
(45) Date of Patent: Jan. 9, 2001

(54) SPOOL WINDER FOR SEWING MACHINES

(76) Inventor: Alma Johnson Gulsby, 2604 Lloyds La., Mobile, AL (US) 36693

( * ) Notice: Under 35 U.S.C. 154(b), the term of this patent shall be extended for 0 days.

(21) Appl. No.: 08/828,858

(22) Filed: Mar. 31, 1997

(51) Int. Cl.[7] ..... D05B 59/00; D05B 43/00
(52) U.S. Cl. ..... 112/279; 112/302
(58) Field of Search ..... 112/279, 302, 112/258, 259, 273, 278; 242/18 R, 20, 23, 46.21, 46.3

(56) References Cited

U.S. PATENT DOCUMENTS 2,508,887 * 5/1950 Orrigo ..... 112/302 X
4,079,686 * 3/1978 Kasuga ..... 112/279 X
4,646,982 * 3/1987 Spring ..... 112/279 X

FOREIGN PATENT DOCUMENTS

523112 * 9/1953 (CA) ..... 112/279
641508 * 2/1984 (CH) ..... 112/279
927066 * 4/1955 (DE) ..... 112/279

* cited by examiner

*Primary Examiner*—Ismael Izaguirre

(57) ABSTRACT

The invention is a removable attachment to the bobbin winder of a conventional sewing machine. It installs on a bobbin winder in lieu of a bobbin at one end and connects to a conventional spool at the opposite end. It provides for continuous winding of thread or yarn onto the spool by preventing disengagement of the bobbin winder. The invention consists of a flanged post which installs onto the bobbin winder's spindle. The post is long and narrow enough to avoid the bobbin winder's disengagement mechanism. This function eliminates the need for hand winding of spools. Once full, said spool may be used normally with any conventional sewing machine, serger, or knitting machine.

9 Claims, 1 Drawing Sheet

SPOOL WINDER FOR SEWING MACHINES

FIELD OF THE INVENTION

The invention relates to sewing machine bobbin winders having fill sensors. More particularly the invention relates to posts for avoiding a bobbin winder sensor on a sewing machine.

SUMMARY OF THE INVENTION

This invention eliminates the need for tedious hand winding of thread or yarn onto a spool. When used in conjunction with the bobbin winder of a typical sewing machine, the invention winds thread from a cone, skein, ball, or hank directly onto a spool. This is accomplished by installing the invention onto the bobbin winder found on most sewing machines. A separate spool may be mounted onto the invention, or the invention and spool may be constructed as a one piece unit. The invention positions the spool away from the bobbin winder's disengagement device, allowing for continuous winding of thread onto the spool with the bobbin winder. Use of the invention in this manner greatly reduces the amount of time and effort required to wind a spool, since hand winding is no longer required. The newly wound spool may then be used normally on any sewing machine, knitting machine, or serger.

DETAILED DESCRIPTION OF THE PREFERRED EMBODIMENT

Figure 1:
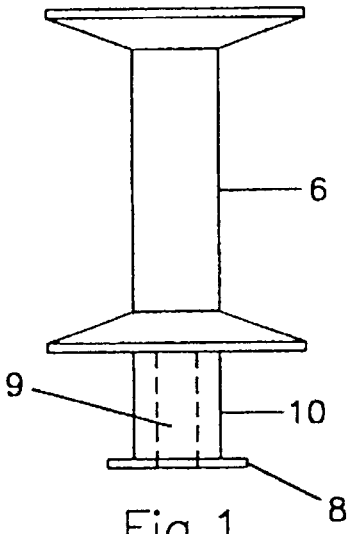
FIG. 1 shows side view of the invention and a spool as an integrated unit.
Figure 2:
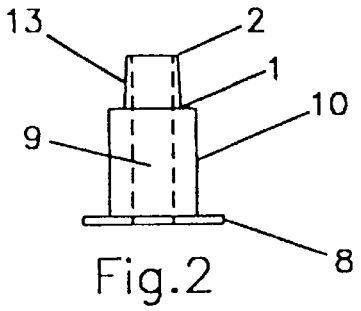
FIG. 2 shows side view of the invention without an integrated spool.
Figure 3:
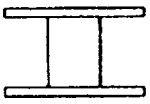
Fig.3 Prior Art
FIG. 3 shows side view of a conventional bobbin.
Figure 4:
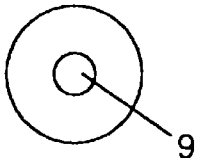
FIG. 4 shows bottom view of the invention.
Figure 5:
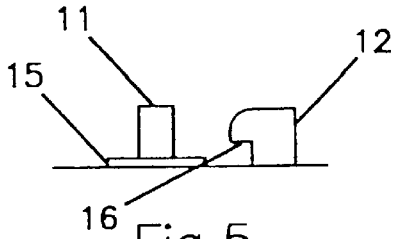
Fig.5 Prior Art
FIG. 5 shows side view of a sewing machine bobbin winder.
Figure 6:
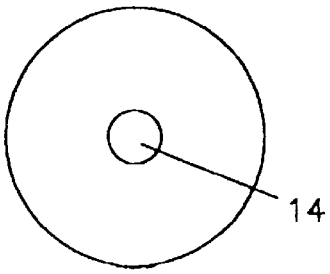
Fig.6 Prior Art
FIG. 6 shows bottom view of a conventional spool.
Figure 7:
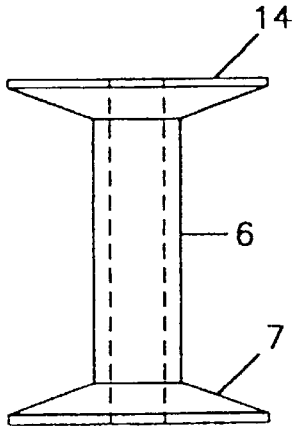
Fig.7 Prior Art
FIG. 7 shows side view of a conventional spool.

FIGS. 1 and 2 show alternative constructions of the invention, both of which begin at the bottom end with a wide base or flange (8) approximately the same size and shape as the end of a typical bobbin, shown in FIG. 3. A longitudinal bore (9) shown in FIG. 4 extends through the flange (8) and into a post (10) which fits onto a bobbin winder spindle (11), as seen in FIG. 5. The diameter of the post (10) is wide enough to slip over the bobbin winder spindle (11), but narrow enough to avoid any interference with the bobbin winder's disengagement mechanism (12), or any other, obstruction which may be found on a particular machine. The invention in FIG. 1 is shown as an appendage on one end of an otherwise typical spool, while the invention as shown in FIG. 2 has a protrusion (13) on the top end which fits into the bore (14) of a conventional spool, shown in FIGS. 6 and 7. The flange of the invention (8) rests on the bobbin winder's spindle plate (15) in place of a bobbin. The post of the invention (10) is of sufficient length to elevate the spool above the bobbin winder's disengagement lever (12) or any other obstructions on the sewing machine. The bobbin winder's disengagement lever (12) does not touch the post (10), and will not come into contact with the thread winding onto the spool, thereby allowing continuous winding when the bobbin winder is activated.

As can be seen by reference to FIG. 2, the protrusion 13 tapers from a wide end 1 to a narrow end 2. Between the wide end 1 and the narrow end 2, the protrusion 13 has the same diameter as the longitudinal bore 14 in the spool 6 so that a tight fit may be established. The spool 6 has a base 7 which defines the end of the bore 14 into which the protrusion 13 is inserted. The flange 8 is wide enough to fit under the disengagement mechanism 12 when the post 10 is put onto the bobbin winder spindle 11.

Because in some units present in the prior art the disengagement mechanism 12 moves upward and downward, the spool 6 is held above the disengagement mechanism on the post 10.

As shown in FIG. 5, the overhand 16 of the disengagement mechanism 12 may not move up and down but may just be a block of fixed diameter and in that case the length of the post 10 would have to be sufficient so that it held the spool 6 above the overhang 16.

I claim:

1. A bobbin holder for attachment to a conventional sewing machine's bobbin winder for mounting a spool having a bore, said bore having a bore diameter and a circumference around the bore diameter and said sewing machine have a top, which bobbin winder has a top and a disengagement mechanism having a sensor means at a sensor height, said sensor means for terminating the winding upon sensing the thread extending beyond the disengagement mechanism's maximum acceptable diameter at the sensor height so as to provide for continuous winding of thread onto a spool comprising:

(1) a post defining a flange said flange having a bottom and having a diameter greater than the diameter of the sensor means and below the sensor means, said flange having a flat base for supporting the post against the bobbin winder top said post having a diameter at the height of the disengagement mechanism sensor which is less than the disengagement mechanism's maximum acceptable diameter (2) said post further comprising a tapered protrusion, said tapered protrusion having along the taper an end diameter substantially equal to the spool bore diameter and where said tapered protrusion inserts into the bore to secure the post to the spool by means of the frictional contact between the end diameter and the bore circumference.

2. The invention of claim 1 wherein the protrusion has a hollow longitudinal bore.

3. The invention of claim 1 wherein the attachment means further comprises a plate on the bobbin winder and a spindle rising above the plate on the bobbin winder and wherein the post longitudinal bore is insertable over the spindle so that the flange fits frictionally against the plate and the longitudinal bore fits against the spindle to secure the bobbin holder to the spindle and plate.

4. An extender peg for use with a spool for receiving a thread where the spool has a spool diameter and a longitudinal bore having a bore diameter, and where said spool is to be mounted on a winder spindle having a sensor to determine fill diameter comprising:

(a) A post having a top and a bottom, said bottom defining a bottom opening to receive the winder spindle and wherein said post further comprises a post diameter, said post diameter being of a diameter less than the fill diameter of the sensor;

(b) a hollow tapered protrusion having a wide end and a narrow end, said wide end being mounted onto the top of the post and wherein the protrusion defines a protrusion diameter between the wide end and the narrow end which protrusion diameter is equal to the spool diameter so that frictional contact may be secured between the tapered protrusion and the spool when the tapered protrusion is inserted within the spool longitudinal bore.

5. The invention of claim 4 wherein the bobbin winder spindle is mounted above a plate and wherein the post bottom further comprises flange for sitting on the plate.

6. The invention of claim 5 wherein the sensor further comprises a sensor arm sensor arm which arm extends over the plate and wherein the flange further comprises a perimeter and wherein the perimeter of the flange extends under the arm where the arm extends over the plate so that the arm assists in holding the plate onto the plate.

7. The invention of claim 6 wherein the bobbin winder is mounted at the top of the sewing machine so that the contact between the bottom of the flange and the top of the bobbin winder is supported by gravity.

8. An extender peg and spool for use with a winder spindle having a sensor to determine fill diameter wherein bobbin winder spindle is mounted above a plate comprising:

(a) A post having a top and a bottom, said bottom defining a bottom opening to receive the winder spindle and wherein said post further comprises a post diameter, said post diameter being of a diameter less than the fill diameter of the sensor and wherein the post bottom further comprises a flange for sitting on the plate and wherein the post is no wider at any point along it's length than the point below it;

(b) a spool mounted onto the top of the post.

9. The invention of claim 8 wherein the sensor further comprises a sensor arm sensor arm extends over the plate and wherein the flange further comprises a perimeter and wherein the perimeter of the flange extends under the arm where the arm extends over the plate so that the arm assists in holding the plate onto the plate.

* * * * *